US006899575B1

(12) United States Patent
Rothe et al.

(10) Patent No.: US 6,899,575 B1
(45) Date of Patent: May 31, 2005

(54) JET DRIVE MARINE PROPULSION SYSTEM WITH A WATER PUMP

(75) Inventors: Neil A. Rothe, Campbellsport, WI (US); Thomas S. Lonnborg, Fond du Lac, WI (US); Ricky G. Jaeger, Van Dyne, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/717,152

(22) Filed: Nov. 19, 2003

(51) Int. Cl.[7] ..... B63H 11/00
(52) U.S. Cl. ..... 440/39; 440/88 R
(58) Field of Search ..... 440/38, 39, 46, 440/47, 88 R; 415/206, 141

(56) References Cited

U.S. PATENT DOCUMENTS

| | | | | |
|---|---|---|---|---|
| 3,601,989 A | | 8/1971 | Austin | 60/221 |
| 3,889,623 A | * | 6/1975 | Arnold | 440/39 |
| 3,906,885 A | | 9/1975 | Woodfill | 440/42 |
| 3,945,201 A | | 3/1976 | Entringer | 60/222 |
| 3,994,254 A | | 11/1976 | Woodfill | 440/1 |
| 4,026,235 A | | 5/1977 | Woodfill | 440/41 |
| 4,392,779 A | * | 7/1983 | Bloemers et al. | 415/141 |
| 4,728,306 A | * | 3/1988 | Schneider | 440/88 R |
| 5,713,768 A | | 2/1998 | Jones | 440/38 |
| 5,713,769 A | | 2/1998 | Jones | 440/38 |
| 5,720,638 A | | 2/1998 | Hale | 440/83 |
| 5,759,074 A | | 6/1998 | Jones | 440/38 |
| 5,876,258 A | | 3/1999 | Gray | 440/46 |
| 6,004,173 A | | 12/1999 | Schott | 440/38 |
| 6,033,272 A | | 3/2000 | Whiteside | 440/46 |
| 6,244,913 B1 | | 6/2001 | Matsumoto et al. | 440/38 |
| 6,513,463 B2 | * | 2/2003 | Katayama | 123/41.29 |
| 6,752,671 B2 | * | 6/2004 | Ishigaki et al. | 440/39 |
| 6,821,167 B2 | * | 11/2004 | Ishigaki et al. | 440/38 |

* cited by examiner

*Primary Examiner*—Lars A. Olson
(74) *Attorney, Agent, or Firm*—William D. Lanyi

(57) ABSTRACT

The present invention provides a water pump in addition to the impeller system of a marine propulsion system. This allows the water pump to operate independently of the impeller if a clutch is provided which disconnects the impeller from torque transmitting relation with an engine. When a clutch is not provided, the independent water pump of the present invention allows the marine propulsion system to be operated at a lower idle speed than would otherwise be possible because the impeller is not relied upon for a flow of cooling water to the engine.

36 Claims, 4 Drawing Sheets

JET DRIVE MARINE PROPULSION SYSTEM WITH A WATER PUMP

BACKGROUND OF THE INVENTION

1. Field of the Invention

The present invention is generally related to a jet drive marine propulsion system and, more specifically, to a jet drive system that incorporates a positive displacement water pump in order to draw water from a body of water and pump the water to a cooling system of an internal combustion engine.

2. Description of the Prior Art

Many different types of jet drive marine propulsion systems are well known to those skilled in the art.

U.S. Pat. No. 3,994,254, which issued to Woodfill on Nov. 30, 1976, discloses a transmission for a marine jet drive. The device includes a multiple-high speed transmission for coupling an engine to the impeller of a marine jet drive, in such a way that an overdrive connection powers the jet drive under operating conditions up to a predetermined upper limit of cruising speeds and such that a reduced drive, for example a direct-drive connection, is automatically established for jet-drive speeds in excess of the cruising conditions.

U.S. Pat. No. 5,713,768, which issued to Jones on Feb. 3, 1998, discloses an intake housing for a personal watercraft. A personal watercraft (PWC) jet propulsion system has a hull design and an intake housing to optimize the structural integrity of the hull and facilitate efficient installation of the jet propulsion system without sacrificing proper alignment of the components of the jet propulsion system. The watercraft hull includes a recess defined by an inclined bulkhead spanning between two substantially vertical side walls. The inclined bulkhead contains an opening between the engine compartment within the hull and the components of the jet propulsion system.

U.S. Pat. No. 3,945,201, which issued to Entringer on Mar. 23, 1976, discloses a marine jet drive shift control apparatus. A marine jet drive unit includes a continuously running pump. A reversing gate is positioned partially or wholly within the forward jet to establish a corresponding reverse jet. For neutral drive, the gate is positioned such that the reverse jet just balances the forward jet. A remote shift control unit includes a detent means for locating and holding a rotatable shift lever in neutral. The detent means includes a pair of detent pins carried by a plate which is connected to a support wall by a slot and bolt lost motion connection.

U.S. Pat. No. 6,004,173, which issued to Schott on Dec. 21, 1999, discloses a marine propulsion system with a bypass eductor. A jet propulsion system is provided for a watercraft in which the secondary flow channel allows water to flow around the impeller region and bypass the impeller blades under certain conditions. The bypass feature provided by the secondary flow channel decreases static inlet pressure and improves the operation of the marine propulsion device at high speeds. In addition, the secondary flow channel increases the total mass flow of water through the steering rudder and therefore improves the steering when the propulsion system is being rapidly decelerated, such as during sudden stopping conditions.

U.S. Pat. No. 5,713,769, which issued to Jones on Feb. 3, 1998, discloses a stator and nozzle assembly for a jet propelled personal watercraft. A jet propulsion system for a personal watercraft provides a converging stator that can be manufactured using die-cast manufacturing techniques. The stator preferably has a stator housing having a substantially cylindrical inner surface, a stator hub, and seven equally spaced stator vanes supporting the hub coaxially in the stator housing. The cylindrical inside surface of the stator housing does not extend rearwardly as far as a conventional housing for a converging stator. The coaxial hub has a converging diameter portion that is located at least in part downstream or rearward of the stator housing.

U.S. Pat. No. 5,876,258, which issued to Gray on Mar. 2, 1999, discloses a self-activated marine jet drive weed grate cleanout system. The weed grate for a watercraft having a jet propulsion unit is described. It includes a plurality of cantilever tines each joined to a pivot rod. The cantilever tines extend across the inlet opening for the jet drive to prevent debris from entering through the water inlet opening. A spring member is mounted between the cantilever tines and a mounting frame such that the spring member provides an outward rotational bias force against the rotatable cantilever tines.

U.S. Pat. No. 4,026,235, which issued to Woodfill on May 31, 1977, discloses a jet drive apparatus with non-steering jet reverse deflector. A jet drive pump is secured to the boat transom and includes a gimbal ring pivoted on a horizontal trim access and a steering nozzle is pivotally mounted on a vertical pivot axis within the gimbal ring for steering. A trim linkage is connected to position the gimbal ring for trimming of the nozzle. A reversing gate is pivotally mounted on the same trim axis and connected by a mechanical coupling linkage with swivel and pivoting joints to the gimbal ring. The linkage has an axially sliding shift shaft in a rotatable shift lever for rotation about an axis perpendicular to the trim axis.

U.S. Pat. No. 3,906,885, which issued to Woodfill on Sep. 23, 1975, discloses a marine jet drive with power trim control and auxiliary rudder steering. A marine jet drive apparatus includes a power trim unit coupled to a jet deflector for remote trim positioning of the jet and for controlling steering deflection of the jet to either side. An auxiliary rudder also coupled to the jet deflector to vary the effectiveness of the auxiliary rudder with the trim positioning is provided. The main jet deflector is a tubular extension of the jet nozzle and is mounted for trim positioning. The main jet deflector is a tubular extension of the jet nozzle and is mounted for trim rotation about a transverse axis by a gimbal ring. A powered trim control link is connected to the ring for setting of the jet with respect to the horizontal.

U.S. Pat. No. 5,759,074, which issued to Jones on Jun. 2, 1998, discloses an impeller mounting system for a personal watercraft. An impeller mounting system uses an impeller shaft having a tapered portion and an impeller hub having a coaxial opening with a corresponding tapered seat. The impeller hub is tightened onto the impeller shaft so that the tapered portion of the impeller shaft presses against the tapered seat of the coaxial opening in the impeller hub with sufficient force to prevent the impeller hub from slipping with respect to the impeller shaft when the impeller shaft rotates to drive the impeller hub. Static frictional forces between the tapered surfaces bear the entire rotational load for the jet drive, therefore reducing chatter noise and wear which can be caused by load bearing splines or the like.

U.S. Pat. No. 5,720,638, which issued to Hale on Feb. 24, 1998, discloses an engine driveshaft coupler for a personal watercraft. A jet propelled watercraft has a coupling assembly to couple an engine crankshaft to a jet pump impeller shaft. The coupling assembly can accommodate substantial engine crankshaft vibrations, yet effectively isolate the jet pump impeller shaft from transverse movement. The coupling assembly includes an engine crankshaft coupling head, an intermediate coupler, an impeller shaft coupling head, and two elastomeric isolators positioned between each of the coupling heads and the intermediate coupler. The intermediate coupler is supported exclusively by the elastomeric isolators and is allowed to tilt transverse to the rotational axis of the intermediate coupler to accommodate engine crankshaft displacement.

U.S. Pat. No. 6,033,272, which issued to Whiteside on Mar. 7, 2000, describes a marine jet drive system with a debris cleanout feature. The system is intended for use for a boat or the like and comprises a power plant for rotating a driveshaft. A gear system is connected to the driveshaft and is configured to engage and rotate an impeller shaft. An impeller mounted to the impeller shaft is enclosed within a housing having a water inlet opening and a jet stream exit opening. The gear system includes a pinion gear connected to the driveshaft and engaging a pair of opposed ring gears, the ring gears being thus rotatable by the pinion gear in opposite directions. A clutch system is provided for selectively causing the impeller shaft to alternatively be engaged by one or the other of the ring gears and thereby selectively rotating the impeller in opposite directions. By this arrangement, rotation of the impeller in a first direction draws water through the housing in normal fashion to provide thrust at the exit opening, while rotation of the impeller in the opposite direction reverses the flow through the housing causing debris to be flushed out of the impeller or inlet opening. A simple control system allows the boat operator to perform the flushing process while occupying the control station of the boat.

U.S. Pat. No. 3,601,989, which issued to Austin on Aug. 31, 1971, describes a marine propulsion system. The system includes a multistage, ducted pump creating a jet of propelling water which is driven from conventional power plants one being a relatively low horsepower diesel engine, the other a high output gas turbine. The former is connected to a single, large diameter first pump stage. The latter is connected to both the single, large diameter stage and the second smaller diameter stage, whereby the second stage is operated at a higher rotational speed. Suitable clutch means, preferably over running clutches provide for smooth transition from the diesel to turbine power mode and vice versa.

U.S. Pat. No. 6,244,913, which issued to Matsumoto et al. on Jun. 12, 2001, describes a propulsion unit assembly for a personal watercraft. The assembly provides for the quick and easy alignment of the propulsion device of the assembly relative to the longitudinal axis of the watercraft when mounting the propulsion device on the hull of the watercraft. The mounting arrangement includes a mounting plate having stoppers which cooperate with bosses formed on the front wall of the tunnel of the watercraft to properly align the mounting plate before fixing the plate to the hull and mounting the propulsion device thereto. In addition, the disclosed propulsion unit assembly includes an integrally formed cooling water supply system which utilizes the existing high-capacity jet pump unit to provide pressurized cooling water for cooling of the engine and associated watercraft components.

The patents described above are hereby expressly incorporated by reference in the description of the present invention.

Jet pumps for use with personal watercraft or jet boats are well known to those skilled in the art. These marine propulsion devices support an impeller for rotation within a water passage, or channel, which has an inlet and an outlet. Water is drawn into the channel through the inlet from a body of water in which the marine vessel is operated and the water is accelerated by the impeller and ejected through the outlet which, in normal applications, includes a nozzle. The water that is ejected through the nozzle at the outlet of the water channel provides thrust that propels a watercraft. An engine is mounted in torque transmitting relation with the impeller shaft. The engine can be mounted with its crankshaft aligned vertically or horizontally. When the engine is mounted with its crankshaft supported for rotation about a vertical axis, a 90 degree transmission is typically provided to connect the vertical crankshaft in torque transmitting relation with the horizontal impeller shaft.

Several inherent conditions exist in conjunction with jet pumps used for propulsion of marine vessels. First, the impeller is normally used to provide a stream of water that is conducted to the engine and connected in fluid communication with the cooling system of the engine. The use of the impeller driven water stream to cool the engine creates two problems. First, the flow of water is affected not only by the rotational speed of the impeller but, in addition, by other factors such as the speed of the watercraft which changes the ram pressure of the water being forced into the inlet of the water channel in which the impeller rotates. This creates a magnitude of water flow to the cooling system of the engine which is not consistently proportional to the engine speed. Another problem relates to the fact that the engine cooling system requires that the impeller constantly remain in a rotating state in order to continually provide cooling water to the engine. The requirement for the continual rotation of the impeller, typically at elevated idle speeds, causes the watercraft to move even when the operator of the watercraft desires to remain at a stationary position. This type of creep of the watercraft is a direct result of the continual expelling of water through the nozzle. It would be significantly beneficial if a jet drive for a marine propulsion system could be provided in which it was not necessary to operate the impeller at elevated idle speeds in order to maintain sufficient cooling water to the engine. In addition, it would be beneficial if the cooling system of an engine for a jet drive marine propulsion system could be provided with a magnitude of cooling water flow that is generally proportional to the engine speed.

SUMMARY OF THE INVENTION

A marine propulsion system, made in accordance with the preferred embodiment of the present invention, comprises a water passage having an inlet opening disposable in fluid communication with a body of water in which the marine propulsion system is operated and an outlet opening from which water can be expelled to provide a propulsive force for a marine vessel. It further comprises an impeller which is connectable in torque transmitting association with an output shaft of an engine. The impeller is disposed within the water passage between the inlet opening and the outlet opening. The present invention also comprises a water pump having an inlet conduit and an outlet conduit, with the inlet conduit being disposable in fluid communication with the body of water in which the marine propulsion system is operated and the outlet conduit being connectable in fluid communication with a cooling system of the engine.

The output shaft of the engine is connected in torque transmitting relation with the impeller. The engine comprises a crankshaft supported for rotation about a vertical axis in certain embodiments of the present invention, although alternative embodiments could comprise an engine with a crankshaft supported for rotation about a horizontal axis. The impeller is attached to an impeller shaft. The impeller shaft can be supported for rotation about a horizontal axis.

The water pump of a preferred embodiment of the present invention is disposed at a location which is below a surface of the body of water when the marine vessel is at rest. The marine vessel can be a personal watercraft or a jet boat. The water pump can be driven by the crankshaft of the engine which operates as the output shaft. A rotor of the water pump can be generally concentric with a driveshaft of the marine propulsion system. The driveshaft is connectable in torque transmitting relation with the crankshaft of the engine. The water pump, in a preferred embodiment of the present invention, is a positive displacement pump. It can be an electric pump that is independent of the output shaft of the engine.

In a preferred embodiment, the present invention further comprises a clutch which is connectable in torque transmitting association between the impeller and the output shaft of the engine. The clutch is configured to disconnect the impeller from torque transmitting relation with the output shaft of the engine. In a preferred embodiment, the clutch is actuated to disconnect the impeller from torque transmitting relation with the output shaft of the engine when the operator of the marine vessel desires to operate in a neutral state with no rotation of the impeller. The water pump can be disposed between the engine and the clutch.

In a preferred embodiment of the present invention, the water pump is operable to pump water from the body of water to the cooling system of the engine independently of the impeller. In other words, the water pump need not depend on the rotation of the impeller about its axis of rotation. This can occur when the clutch is actuated to uncouple the impeller from the output shaft of the engine. The inlet conduit of the water pump can be disposed in fluid communication with the water passage. More particularly, the inlet conduit of the water pump can be disposed proximate the inlet of the water passage.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
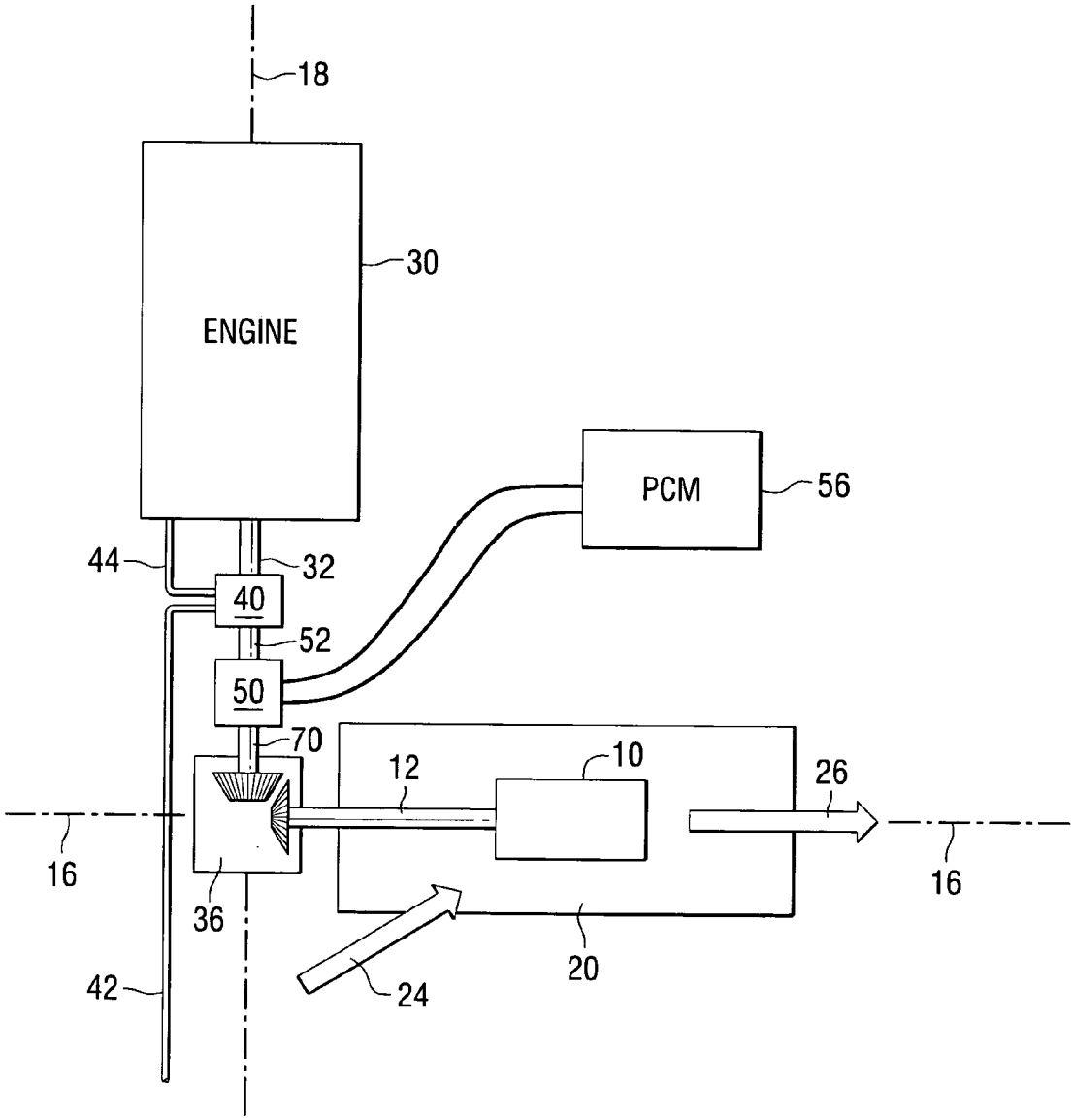
FIG. 1 is a simplified schematic representation of one embodiment of the present invention.

Throughout the description of the preferred embodiment of the present invention, like components will be identified by like reference numerals.

As is well known by those skilled in the art, jet pump marine propulsion systems can be used in conjunction with personal watercraft, such as the system described in U.S. Pat. No. 5,713,768, or jet boats, such as the one described in U.S. Pat. No. 3,945,201. Known types of jet propelled watercraft use a marine propulsion system that supports an impeller for rotation with an impeller shaft about the horizontal axis. This arrangement is illustrated in U.S. Pat. No. 5,713,769. Water is drawn into an inlet passage and induced to flow through a region where the impeller is mounted and is rotating. This water is accelerated and passed through an outlet of the water passage which is shaped to form a nozzle. As the water exits the nozzle portion, it provides a thrust that propels the watercraft. The basic structure of the water passage, impeller, and impeller shaft is described in U.S. Pat. No. 5,759,074. In order to provide cooling water to the engine used to drive the impeller, jet pumps of this type are provided with a conduit that directs a flow of water from the region of the impeller to the cooling system of the engine. This type of arrangement is described in detail in U.S. Pat. No. 6,244,913.

As described above, known jet propulsion systems for marine vessels require that the impeller continually rotates whenever the engine is operative. This is necessary to direct a flow of coolant water from the region of the impeller to the cooling system of the engine, whether the engine is mounted with its crankshaft supported for vertical or horizontal rotation. This requirement that the impeller rotate about its axis whenever the engine is operating results in a disadvantageous situation when the operator of the marine vessel desires to maintain the marine vessel in a stationary position. Although various gates have been developed to deflect the water appropriately in order to prevent significant forward movement of the marine vessel, these systems are imperfect and typically result in a deleterious movement of the vessel even when the operator attempts to maintain it in a stationary position with the engine operating at idle speed. A related problem relates to the fact that, in order to provide a sufficient flow of water to the cooling system of the engine, the idle speed of these marine propulsion systems typically must be maintained at a higher than normal rate. If the impeller was not used to provide a flow of water to the cooling system of the engine, it would be possible to operate the engine at a lower idle speed. This, in turn, could help alleviate the creep problem associated with the requirement that the impeller continually rotate as long as the engine is operating.

The present invention is directed to provide a solution for the creep of a jet propelled watercraft when it is operated at idle speed. This solution is provided in several ways, as will be described in greater detail below. By providing a water pump that is independent of the rotation of the impeller, adequate water supply can be provided to the engine regardless of whether or not the impeller is rotating or at what speed the impeller is rotating. By using an independent water pump, which would typically be a positive displacement water pump, the impeller is not needed to direct the flow of water to the cooling system of the engine. At a minimum, this allows the idle speed of the engine to be lowered because the impeller is not the primary source in pumping water to the cooling system.

In addition, if an independent water pump is provided, a clutch can also be provided that literally disconnects the impeller from torque transmitting relation with the engine when the operator desires to maintain the position of the watercraft at a stationary location. This eliminates any possibility of creep of the watercraft when operated in this mode with the clutch disconnecting the impeller from torque transmitting relation with the engine.

Even if no clutch is used in conjunction with the provision of the independent water pump, the lowered idle speed of the engine will alleviate most of the problems relating to creep of the watercraft when the engine is operated at idle speed because the idle speed can typically be much lower than would otherwise be possible if the impeller was required to induce the flow of cooling water to the engine. Another advantage is achieved through the use of an independent water pump by the present invention. The flow of water through a positive displacement water pump is much more proportional to the actual engine speed than the flow of water provided by an impeller. When an impeller is used to provide the cooling water flow, ram pressure through the water passage, as a result of the speed of the watercraft, can significantly affect the magnitude of water flow passing the impeller. As a result, the water flow is not directly proportional to the speed of the engine.

When an independent positive displacement water pump is used, the flow through the pump to the cooling system of the engine is much more directly proportional to the speed of the engine. This, in turn, provides a more reliable cooling flow that neither overheats nor overcools the engine.

Another advantage of the present invention is that it can provide an electric pump which is also independent of the output shaft of the engine. In other words, the water pump can be operated at a speed which is determined as a function of the actual temperature of the cooling water within the engine. If the temperature of the cooling water rises above a desired range, the speed of the electric water pump can be increased to increase the flow of cooling water through the engine cooling system. If, on the other hand, the temperature of the cooling water is below the desired range, the speed of the electric water pump can be decreased to raise the temperature of the engine to the desired range.

FIG. 1 is a highly schematic representation of a jet pump marine propulsion system. An impeller 10 is attached to an impeller shaft 12 for rotation about a generally horizontal axis 16. The impeller is disposed within a water passage 20. Water is directed through an inlet opening, as represented by arrow 24, accelerated by the impeller 10, and ejected, as represented by arrow 26, through a nozzle. The specific structure of the inlet opening and the nozzle are not shown in FIG. 1, but are illustrated in detail in the patents described above. In addition, these portions of the structure will be described in greater detail below.

The engine 30 is shown mounted with its crankshaft 32 supported for rotation about a vertical axis 18. A transmission 36 which comprises a plurality of bevel gears, is provided to connect the crankshaft of the engine 30 in torque transmitting relation with the impeller 10.

With continued reference to FIG. 1, a water pump 40 is provided with an inlet conduit 42 and an outlet conduit 44. The inlet conduit 42 is disposable in fluid communication with the body of water in which the marine propulsion system is operated. The outlet conduit 44 is connectable in fluid communication with a cooling system of the engine 10. Although the cooling system is not illustrated in FIG. 1, those skilled in the art of engine design are familiar with many different known types of cooling systems for engines which typically comprise passages formed in the engine block and cylinder head of the engine.

In FIG. 1, a clutch 50 is shown associated with the output shaft 52 which, in a preferred embodiment of the present invention, is an extension of or connected in torque transmitting relation with the crankshaft 32. The clutch 50 is shown connected in signal communication with a propulsion control module 56. However, it should be understood that a more basic application of the present invention could control the clutch 50 as a direct result of a manually controlled throttle being positioned for idle speed. When the clutch 50 is actuated, it disconnects the crankshaft 32 of the engine 30 from torque transmitting relation with the impeller shaft 12. When this is done, it can be seen that the pump 40 continues to be driven by the engine 30 independently of the impeller 10 which would naturally slow or stop as a result of the disconnection between the output shaft 52 and the impeller shaft 12. The engine 30 would continue to receive a flow of cooling water because the water pump 40 continues to be driven by the engine 30 and water continues to be pumped through the inlet conduit 42 and outlet conduit 44 to the cooling system of the engine.

Figure 2:
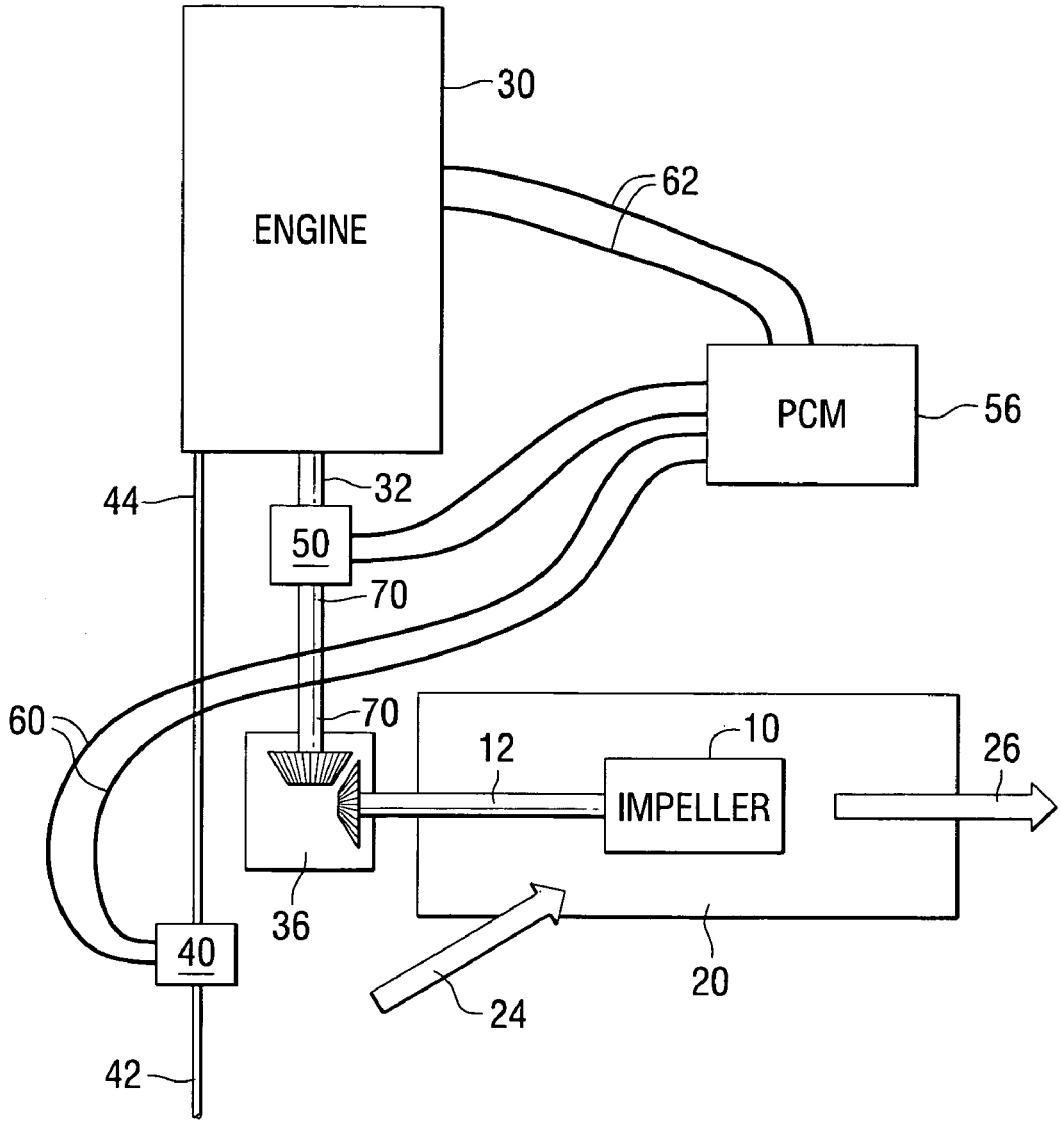
FIG. 2 is a simplified schematic representation of a second embodiment of the present invention.

FIG. 2 is similar to the system shown in FIG. 1, but with a modification relating to the position of the water pump 40. Instead of being driven mechanically by the crankshaft 32 of the engine 30, the water pump 40 is an electric pump which can be operated independently of the crankshaft. Instead, the propulsion control module 56 can provide signals, on lines 60, which can be pulse width modulated (PWM) signals, to control the speed of the water pump 40. The propulsion control module 56 can receive signals on lines 62 related to the actual temperature of the engine 30 and use this information to regulate the rotational speed of the electric water pump 40. In an application of this type, the flow of cooling water to the engine 30 is independent of the operating speed of the engine 30 and the rotational speed of the impeller 10.

The present invention will be described in greater detail below in conjunction with FIGS. 3 and 4. However, the simplified schematic representations in FIGS. 1 and 2 illustrate the basic components of the present invention. The water passage 20 is provided with an inlet opening, through which water flows as represented by arrow 24, which is disposable in fluid communication with a body of water in which the marine propulsion system is operated. This arrangement is well known to those skilled in the art. The system also comprises an outlet opening, through which water can be expelled as represented by arrow 26, that normally incorporates a nozzle to provide propulsive force for the marine vessel. An impeller 10 is connectable in torque transmitting association with an output shaft 52 of the engine 30 which, in certain embodiments, can be separate from, but connected to, the crankshaft 32. However, in a typical application of the present invention, the output shaft 52 is integral with the crankshaft 32. A water pump 40 has an inlet conduit 42 and an outlet conduit 44. The inlet conduit 42 is disposable in fluid communication with the body of water in which the marine propulsion system is operated. The outlet conduit 44 is connectable in fluid communication with the cooling system of the engine 30. The output shaft 52 of the engine is connectable in torque transmitting relation with the impeller 10. In the embodiments shown in FIGS. 1 and 2, the engine comprises a crankshaft that is supported for rotation about a vertical axis 18. The impeller 10 is attached to an impeller shaft 12 for rotation about a horizontal axis 16. The water pump 40, in a preferred embodiment of the present invention, is disposed at a location which is naturally below the surface of the body of water when the marine vessel is at rest. This provides a self-priming characteristic for the water pump 40.

The marine vessel can be a personal watercraft.

In the embodiment shown in FIG. 1, the water pump 40 is driven by the crankshaft 32. In the illustration of FIG. 1, the output shaft is the crankshaft. A rotor of the water pump 40 is concentric with the driveshaft 70 that is provided as an input shaft to the transmission 36. The driveshaft 70 is connectable in torque transmitting relation with the crankshaft 32 of the engine. It should be understood that the engine 30 and the structure incorporating the impeller 10 are typically manufactured so as to be easily separable from each other. As a result, the driveshaft 70 of the marine propulsion system is typically connectable to an output shaft 52 or crankshaft 32 of the engine 30 by a spline connection. This allows the engine 30 to be easily assembled in torque transmitting association with the driveshaft 70 of the marine propulsion system. Although not required in all embodiments of the present invention, this particular arrangement simplifies the assembly of the engine 30 to the marine propulsion system by causing the spline connection between the output shaft 52 and the driveshaft 70 to be coupled.

With continued reference to FIGS. 1 and 2, the water pump 40 is a positive displacement pump in a preferred embodiment of the present invention. The water pump 40 can be an electric pump as shown in FIG. 2 or it can be mechanically driven by the engine 30 as shown in FIG. 1. A clutch 50 is connectable in torque transmitting association between the impeller 10 and the output shaft 52 of the engine 30. The clutch is configured to disconnect the impeller 10 from torque transmitting relation with the output shaft 52 of the engine. In the embodiment shown in FIG. 1, the water pump 40 is disposed between the engine 30 and the clutch 50. The water pump 40, in both embodiments of the present invention shown in FIGS. 1 and 2, is operable to pump water from the body of water to the cooling system of the engine 30 independently of the impeller 10. However, in embodiments of the present invention which do not incorporate a clutch 50, the water pump 40 is not totally independent from the rotation of the impeller 10 because they are both directly driven by the engine 30. The inlet conduit 42 of the water pump 40 can be disposed in fluid communication with the water passage 20 although this arrangement is not illustrated in FIGS. 1 and 2.

Figure 3:
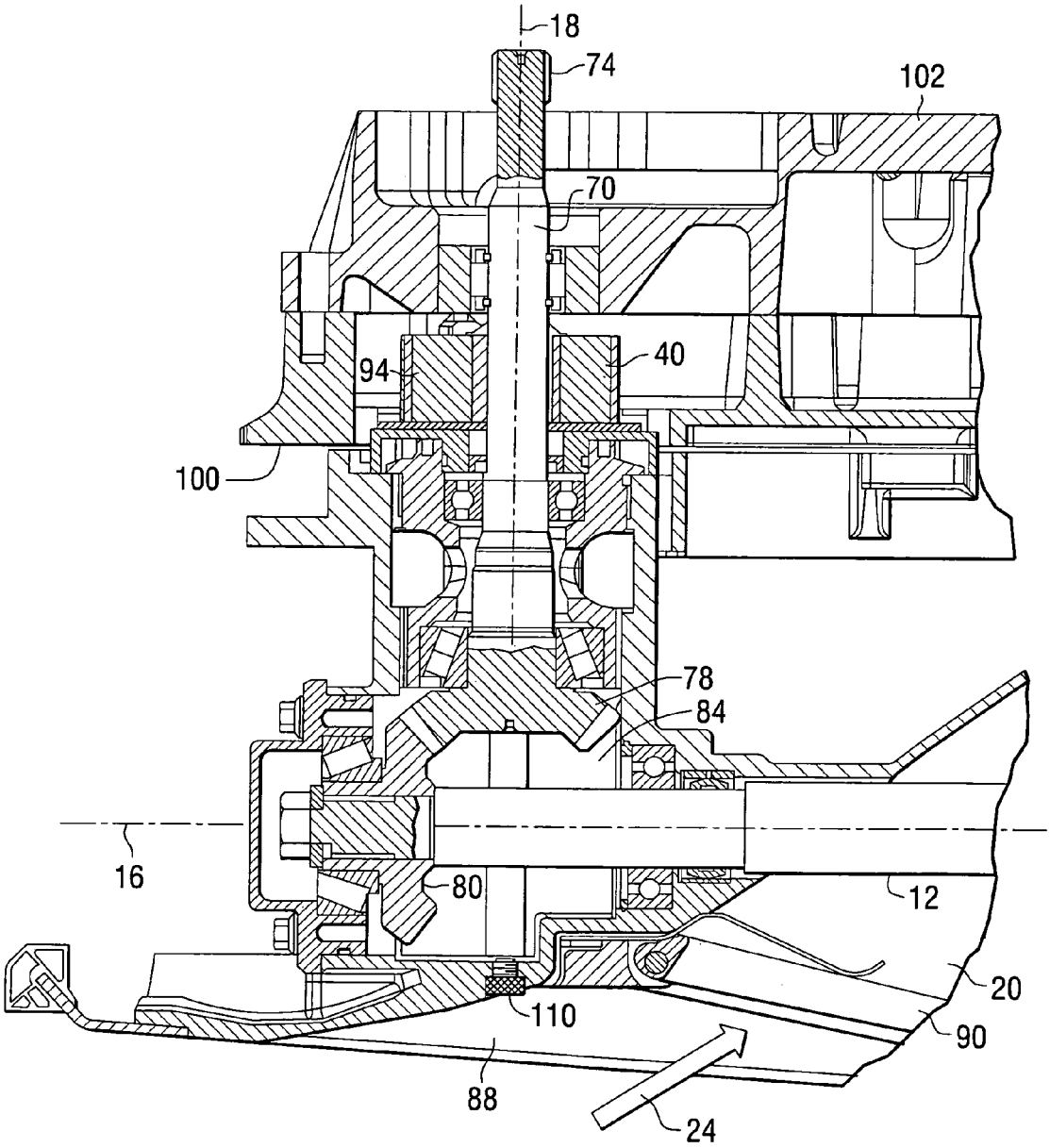
FIG. 3 is a side section view of a marine propulsion system incorporating the present invention.

FIG. 3 is a section view of a marine propulsion system made in accordance with a preferred embodiment of the present invention. In FIG. 3, the driveshaft 70 of the marine propulsion system is provided with spline 74 which allows it to be connected in torque transmitting relation with the output shaft 52 of the engine. As described above, the output shaft 52 of the engine 30 can be integral with the crankshaft 32 or, alternatively, can be attached to it. The driveshaft 70 is provided with a bevel gear 78 at its lower end. This bevel gear 78 is connected in torque transmitting relation with a bevel gear 80 that is attached to the impeller shaft 12. In embodiments of the present invention which incorporate a clutch, the clutch mechanism can be located in the cavity identified by reference numeral 84. Typically, the clutch would operate as a dog clutch that connects the impeller shaft 12 to the bevel gear 80 or, alternatively, disconnects these two components from torque transmitting relation with each other. This allows the operator of a marine vessel to operate the engine 30 without causing the impeller 10 to rotate. However, it should be understood that this ability to disconnect the impeller 10 from torque transmitting relation with the engine 30 is not required in all embodiments of the present invention. In the lower portion of FIG. 3, the water passage 20 is shown having an inlet 88 through which water can pass, as represented by arrow 24, into the water passage 20. A grate 90 can be disposed across a portion of the inlet 88 to prevent debris from passing into contact with the impeller 10.

The water pump 40 is shown disposed in concentric relation with the driveshaft 70. The internal rotor 94 of the water pump 40 is attached to the driveshaft 70 for rotation with it about axis 18. Although not shown in FIG. 3, an inlet conduit 42 extends downwardly from the water pump 40 to provide fluid communication with the region of the water passage 20 that is proximate the inlet 88. This relationship will be described in greater detail below in conjunction with FIG. 4. For purposes of reference, certain other components are identified in FIG. 3. For example, a pump cover 100 provides a containment surrounding the water pump 40. In addition, an engine adaptor 102 is shown. The engine 30, described above in conjunction with FIGS. 1 and 2, would be disposed on the engine adapter 102 with its crankshaft connected in torque transmitting relation with the driveshaft 70. Reference numeral 16 identifies the axis of rotation of the impeller shaft 12.

Figure 4:
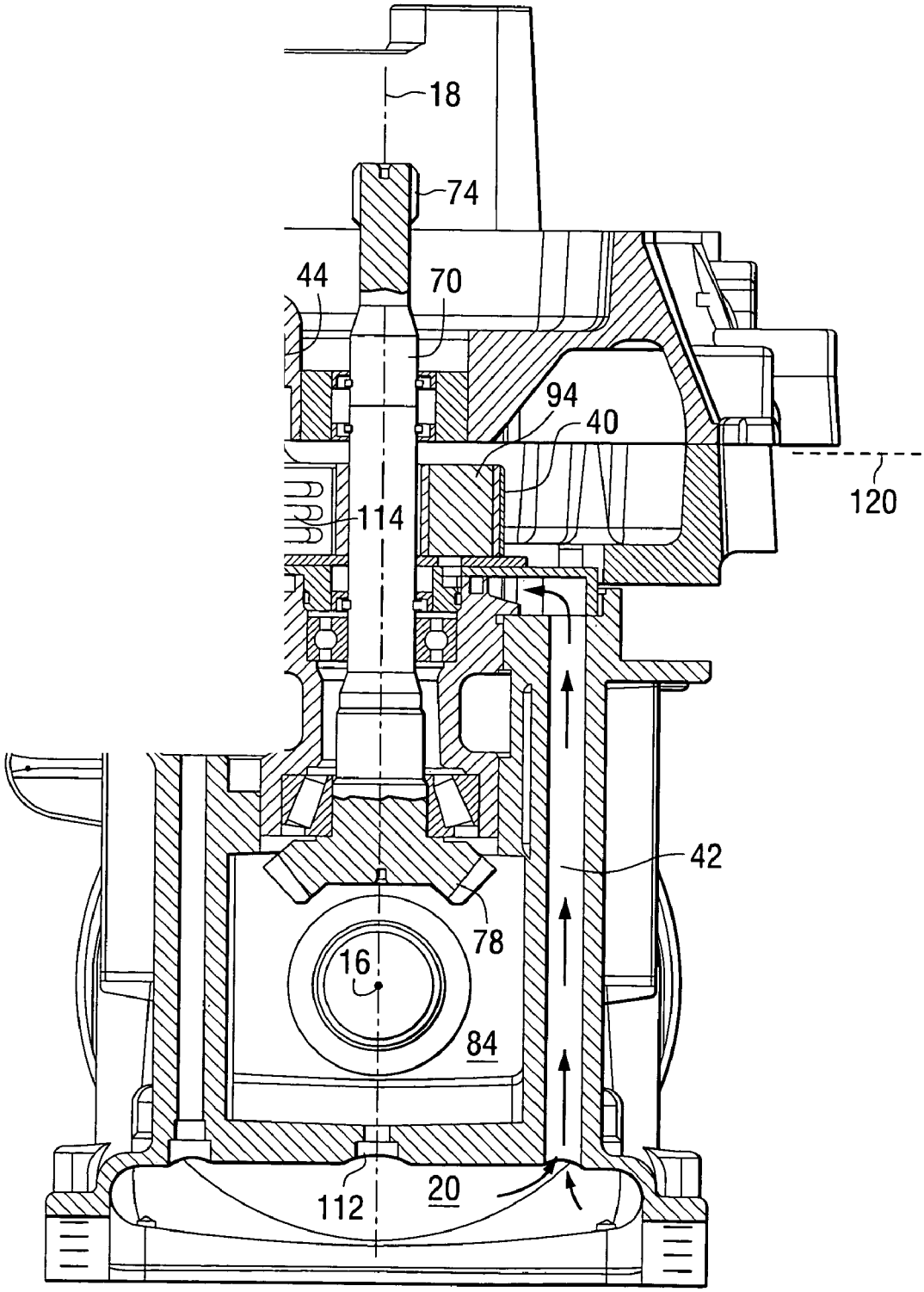
FIG. 4 is a section view taken perpendicularly to the section view shown in FIG. 3.

FIG. 4 is a section view of the marine propulsion system incorporating the present invention which is taken in a direction perpendicular to the section view shown in FIG. 3. In FIG. 4, the water pump 40 is shown having an inlet conduit 42 extending downwardly into fluid communication with the water passage 20 near its opening 88. For purposes of reference, the plug 110 in FIG. 3 is at the same location as the plug opening 112 in FIG. 4. This shows that, in FIG. 3, the inlet conduit 42 would extend downwardly in general alignment with the axis 18 and provides fluid communication with the opening 88 of the water passage 20 in front of the plug 110 in FIG. 3. Water is drawn into the lower end of the inlet conduit 42, as represented by the arrows in that vicinity, and drawn upwardly through the inlet conduit 42 toward the water pump 40. Rotation of the rotor 94 and its flexible vanes, allow the water pump 40 to induce a flow of water out of its slots 114 and toward the outlet conduit 44, as represented by arrows extending from the slots 114 toward the outlet conduit 44. From the outlet conduit 44, water can be directed into the cooling channels of the engine 30, as described above in conjunction FIGS. 1 and 2. For purposes of reference, the cavity 84 is identified in FIG. 4 along with the bevel gear 78 that is attached to the lower end of the driveshaft 70.

The embodiments of the present invention shown in FIGS. 1, 3, and 4, illustrate the attachment of the water pump 40 in concentric relation with the driveshaft 70 and with the crankshaft of the engine 30. It should be understood that other embodiments of the present invention could use an electric pump which can be attached independently of the driveshaft 70. In other words, an electric pump can be placed virtually anywhere in a marine vessel and connected between the body of water and the cooling passages of the engine 30 with appropriate conduits.

With references to FIGS. 1–4, it can be seen that a marine propulsion system made in accordance with the present invention comprises a water passage 20 having an inlet opening 88 disposable in fluid communication with a body of water in which the marine propulsion system is operated. It also comprises an outlet opening, normally with a nozzle structure, from which water can be expelled to provide a propulsive force for a marine vessel, as represented by arrow 26. The invention further comprises an impeller 10 connectable in torque transmitting association with an output shaft 32 of the engine 30. The impeller 10 is disposed within the water passage 20 between the inlet opening 88 and the outlet opening. A water pump 40 has an inlet conduit 42 and an outlet conduit 44. The inlet conduit 42 is disposable in fluid communication with the body of water in which the marine propulsion system is operated. The outlet conduit 44 is connectable in fluid communication with a cooling system of the engine.

The engine 30 is provided with its output shaft, 32 or 52, connected in torque transmitting relation with the impeller 10. The engine comprises a crankshaft 32 supported for rotation about a vertical axis 18 in certain embodiments of the present invention, but an engine with a horizontal crankshaft is also within the scope of the present invention. The impeller 10 is attached to an impeller shaft 12 for rotation with the impeller shaft which, in turn, is supported for rotation about a horizontal axis 16. A water pump 40 is preferably disposed at a location which is below a surface of the body of water when the marine vessel is at rest. The surface of water under these conditions is represented by dashed line 120 in FIG. 4. However, the specific location of the water surface 120 is not limiting to the present invention. The present invention can be used with a marine vessel, such as a personal watercraft or a jet boat. The water pump 40 is driven by the crankshaft 32. The rotor 94 of the water pump 40 is generally concentric with the driveshaft 70 of the marine propulsion system in a preferred embodiment. The driveshaft 70 is connectable in torque transmitting relation with the crankshaft 32 of the engine 30. In a preferred embodiment, the water pump 40 is a positive displacement pump. It can be an electric pump. A clutch 50 is connectable in torque transmitting association with the impeller 10 and the output shaft 70 of the engine. The clutch 50 is configured to disconnect the impeller 10 from torque transmitting relation with the output shaft 52 of the engine 30. The water pump 40 can be disposed between the engine 30 and the clutch 50 in certain embodiments of the present invention. The water pump 40 is operable to pump water from the body of water to the cooling system of the engine 30 independently of the impeller 10. The water pump 40 is disposed at a location external to the water passage 20. The inlet conduit 42 of the water pump 40 is disposed in fluid communication with the water passage 20 in a preferred embodiment.

Although the present invention has been described with particular specificity and illustrated to show a preferred embodiment, it should be understood that alternative embodiments are also within its scope.

We claim:

1. A marine propulsion system, comprising:

a water passage having an inlet opening disposable in fluid communication with a body of water in which said marine propulsion system is operated and an outlet opening from which water can be expelled to provide a propulsive force for a marine vessel;

an impeller connectable in torque transmitting association with an output shaft of an engine, said impeller being disposed within said water passage between said inlet opening and said outlet opening;

a water pump having an inlet conduit and an outlet conduit, said inlet conduit being disposable in fluid communication with said body of water in which said marine propulsion system is operated, said outlet conduit being connectable in fluid communication with a cooling system of said engine; and a clutch connectable in torque transmitting association between said impeller and said output shaft of said engine said clutch being configured to disconnect said impeller from torque transmitting relation with said output shaft of said engine.

2. The system of claim 1, wherein:

said engine is attached in torque transmitting relation with said impeller.

3. The system of claim 1, wherein:

said engine comprises a crankshaft supported for rotation about a vertical axis.

4. The system of claim 1, wherein:

said impeller is attached to an impeller shaft for rotation with said impeller shaft which is supported for rotation about a horizontal axis.

5. The system of claim 1, wherein:

said water pump is disposed at a location which is below a surface of said body of water when said marine vessel is at rest.

6. The system of claim 1, wherein:

said water pump is disposed outside of said water passage.

7. The system of claim 2, wherein:

said water pump is driven by said crankshaft, said output shaft being said crankshaft.

8. The system of claim 1, wherein:

a rotor of said water pump is generally concentric with a driveshaft of said marine propulsion system.

9. The system of claim 8, wherein:

said driveshaft is connectable in torque transmitting relation with said crankshaft of said engine.

10. The system of claim 1, wherein:

said water pump is a positive displacement pump.

11. The system of claim 1, wherein:

said water pump is an electric pump.

12. The system of claim 1, wherein:

said water pump is disposed between said engine and said clutch.

13. The system of claim 1, wherein:

said water pump is operable to pump water from said body of water to said cooling system of said engine independently of said impeller.

14. The system of claim 1, wherein:

said inlet conduit of said water pump is disposed in fluid communication with said water passage.

15. A marine propulsion system, comprising:

a water passage having an inlet opening disposable in fluid communication with a body of water in which said marine propulsion system is operated and an outlet opening from which water can be expelled to provide a propulsive force for a marine vessel;

an impeller connectable in torque transmitting association with an output shaft of an engine, said impeller being disposed within said water passage between said inlet opening and said outlet opening, said impeller being attached to an impeller shaft for rotation with said impeller shaft which is supported for rotation about a horizontal axis; and an electric water pump having an inlet conduit and an outlet conduit, said inlet conduit being disposable in fluid communication with said body of water in which said marine propulsion system is operated, said outlet conduit being connectable in fluid communication with a cooling system of said engine, said electric water pump being displaced from said water passage.

16. The system of claim 15, wherein:

said electric water pump is disposed at a location which is below a surface of said body of water when said marine vessel is at rest.

17. The system of claim 15, wherein:

said electric water pump is driven by said crankshaft, said output shaft being said crankshaft.

18. The system of claim 15, wherein:

a rotor of said electric water pump is generally concentric with a driveshaft of said marine propulsion system.

19. The system of claim 18, wherein:

said driveshaft is connectable in torque transmitting relation with said crankshaft of said engine.

20. The system of claim 19, wherein:

said electric water pump is a positive displacement pump.

21. The system of claim 15, further comprising:

a clutch connectable in torque transmitting association between said impeller and said output shaft of said engine, said clutch being configured to disconnect said impeller from torque transmitting relation with said output shaft of said engine.

22. The system of claim 21, wherein:

said electric water pump is disposed between said engine and said clutch.

23. The system of claim 15, wherein:

said electric water pump is operable to pump water from said body of water to said cooling system of said engine independently of said impeller.

24. The system of claim 15, wherein:

said inlet conduit of said electric water pump is disposed in fluid communication with said water passage.

25. The system of claim 15, wherein:

said engine is attached in torque transmitting relation with said impeller.

26. The system of claim 25, wherein:

said engine comprises a crankshaft supported for rotation about a vertical axis.

27. The system of claim 15, wherein:

said marine vessel is a personal watercraft.

28. A marine propulsion system, comprising:

an engine;

a water passage having an inlet opening disposable in fluid communication with a body of water in which said marine propulsion system is operated and an outlet opening from which water can be expelled to provide a propulsive force for a marine vessel;

an impeller connectable in torque transmitting association with an output shaft of an engine, said impeller being disposed within said water passage between said inlet opening and said outlet opening, said impeller being attached to an impeller shaft for rotation with said impeller shaft which is supported for rotation about a horizontal axis;

a water pump having an inlet conduit and an outlet conduit, said inlet conduit being disposable in fluid communication with said body of water in which said marine propulsion system is operated, said outlet conduit being connectable in fluid communication with a cooling system of said engine, said water pump being a positive displacement pump; and a clutch connectable in torque transmitting association between said impeller and said output shaft of said engine said clutch being configured to disconnect said impeller from torque transmitting relation with said output shaft of said engine.

29. The system of claim 28, wherein:

said water pump is disposed at a location which is below a surface of said body of water when said marine vessel is at rest.

30. The system of claim 29, wherein:

said engine comprises a crankshaft supported for rotation about a vertical axis.

31. The system of claim 30, wherein:

said water pump is driven by said crankshaft, said output shaft being said crankshaft, a rotor of said water pump being generally concentric with a driveshaft of said marine propulsion system.

32. The system of claim 31, wherein:

said driveshaft is connectable in torque transmitting relation with said crankshaft of said engine.

33. The system of claim 28, wherein:

said water pump is an electric pump.

34. The system of claim 28, wherein:

said water pump is operable to pump water from said body of water to said cooling system of said engine independently of said impeller.

35. The system of claim 28, wherein:

said inlet conduit of said water pump is disposed in fluid communication with said water passage.

36. The system of claim 28, wherein:

said marine vessel is a personal watercraft.

* * * * *